United States Patent [19]

Miciukiewicz et al.

[11] Patent Number: 4,938,129

[45] Date of Patent: Jul. 3, 1990

[54] MAILING MACHINE INCLUDING IMPROVED IMPRESSION ROLLER

[75] Inventors: Joseph F. Miciukiewicz, Trumbull, Conn.; Alfred J. Santilli, Mamaroneck, N.Y.

[73] Assignee: Pitney Bowes, Stamford, Conn.

[21] Appl. No.: 413,808

[22] Filed: Sep. 28, 1989

[51] Int. Cl.[5] ..... B41J 45/00

[52] U.S. Cl. ..... 101/76; 101/91; 29/125; 400/661.3

[58] Field of Search ..... 101/76, 77, 84–89, 101/91, 216, 219; 29/121.5, 125, 130, 110; 400/661.3

[56] References Cited

U.S. PATENT DOCUMENTS

| | | | |
|---|---|---|---|
| 700,513 | 5/1902 | Lange | 29/125 |
| 875,528 | 2/1907 | Hirth | 29/125 |
| 896,000 | 8/1908 | Forsyth | 29/125 |
| 998,510 | 7/1911 | Heron | 29/125 |
| 1,463,801 | 8/1923 | Cosgrove et al. | 29/125 |
| 1,600,841 | 9/1926 | Neall | 29/125 |
| 2,374,194 | 4/1945 | Grupe | 29/125 |
| 4,425,694 | 1/1984 | Somerville | 29/110 |
| 4,470,349 | 9/1984 | Godlewski | 101/76 |
| 4,583,272 | 4/1986 | Keller | 29/110 |
| 4,903,591 | 2/1990 | Nobile | 101/91 |

*Primary Examiner*—Eugene H. Eickholt

*Attorney, Agent, or Firm*—Donald P. Walker; Melvin J. Scolnick; David E. Pitchenik

[57] ABSTRACT

In a mailing machine including an impression roller, a postage indicia printing drum overhanging the impression roller, and apparatus for rotating the impression roller and drum in timed relationship with one another for feeding a sheet beneath the drum and in printing engagement therewith, wherein the feeding apparatus includes shaft structure on which the impression roller is mounted for rotation therewith, there is provided an improved impression roller. The impression roller comprises: two annularly-shaped inner members made of a soft resilient material, the inner members coaxially mounted side by side on the shaft structure; two annularly-shaped outer member made of a hard resilient material, the outer members coaxially mounted on the inner members; and four annularly-shaped disc members made of a hard resilient material, the disc members coaxially mounted on the shaft structure, each of the disc members dimensioned such that the width thereof is half the width of an outer member, and each of the disc members including a plurality of apertures formed therethrough at equidistantly spaced intervals along a circular line extending coaxially thereof. Preferably, each of the disc members is not more than substantially one-eighth of an inch in width.

25 Claims, 3 Drawing Sheets

MAILING MACHINE INCLUDING IMPROVED IMPRESSION ROLLER

BACKGROUND OF THE INVENTION

This invention is generally concerned with printing postage indicia on irregularly-shaped letter mailpieces and more particularly with a mailing machine including a postage indicia printing drum and an improved impression roller for urging stepped letter mailpieces into printing engagement with the drum.

A significant proportion of the approximately one-half billion irregularly-shaped mailpieces, flats and parcels annually prepared for processing by the U.S. Postal Service (USPS) consist of stepped letter mailpieces which have been manually processed for printing postage indicia thereon. This is primarily due to commercially available mailing machines, which are utilized by large mailers for automatically processing the bulk of the letter mailpieces prepared for processing by the USPS, cannot be relied upon to print clear and complete, undistorted, postage indicia on stepped letter mailpieces. In particular, this is due to such stepped letter mailpieces including an elongate ridge, formed in the upper surface of the envelope by its contents, which interferes with proper printing engagement of the postage indicia printing drum and the upper surface of the envelope. Accordingly:

An object of the invention is to provide a mailing machine including improved means for printing postage indicia on stepped letter mailpieces; and Another object is to provide, in a mailing machine including a rotary postage indicia printing drum, an improved impression roller for urging stepped letter mailpieces into printing engagement with the drum.

SUMMARY OF THE INVENTION

In a mailing machine including an impression roller, a postage indicia printing drum overhanging the impression roller, and means for rotating the impression roller and drum in timed relationship with one another for feeding a sheet beneath the drum and in printing engagement therewith wherein the feeding means includes shaft means on which the impression roller is mounted for rotation therewith, there is provided an improved impression roller. The impression roller comprises: two annularly-shaped inner members made of a soft resilient material, the inner members coaxially mounted side by side on the shaft means; two annularly-shaped outer members made of a hard resilient material, the outer members coaxially mounted on the inner members; and four annularly-shaped disc members made of a hard resilient material, the disc members coaxially mounted on the shaft means, each of said disc members dimensioned such that the width thereof is half the width of an outer member, and each of said disc members including a plurality of apertures formed therethrough at equidistantly spaced intervals along a circular line extending coaxially thereof.

BRIEF DESCRIPTION OF THE DRAWINGS

As shown in the drawings wherein like reference numerals designate like or corresponding parts throughout the several views.

DESCRIPTION OF THE PREFERRED EMBODIMENTS

Figure 1:
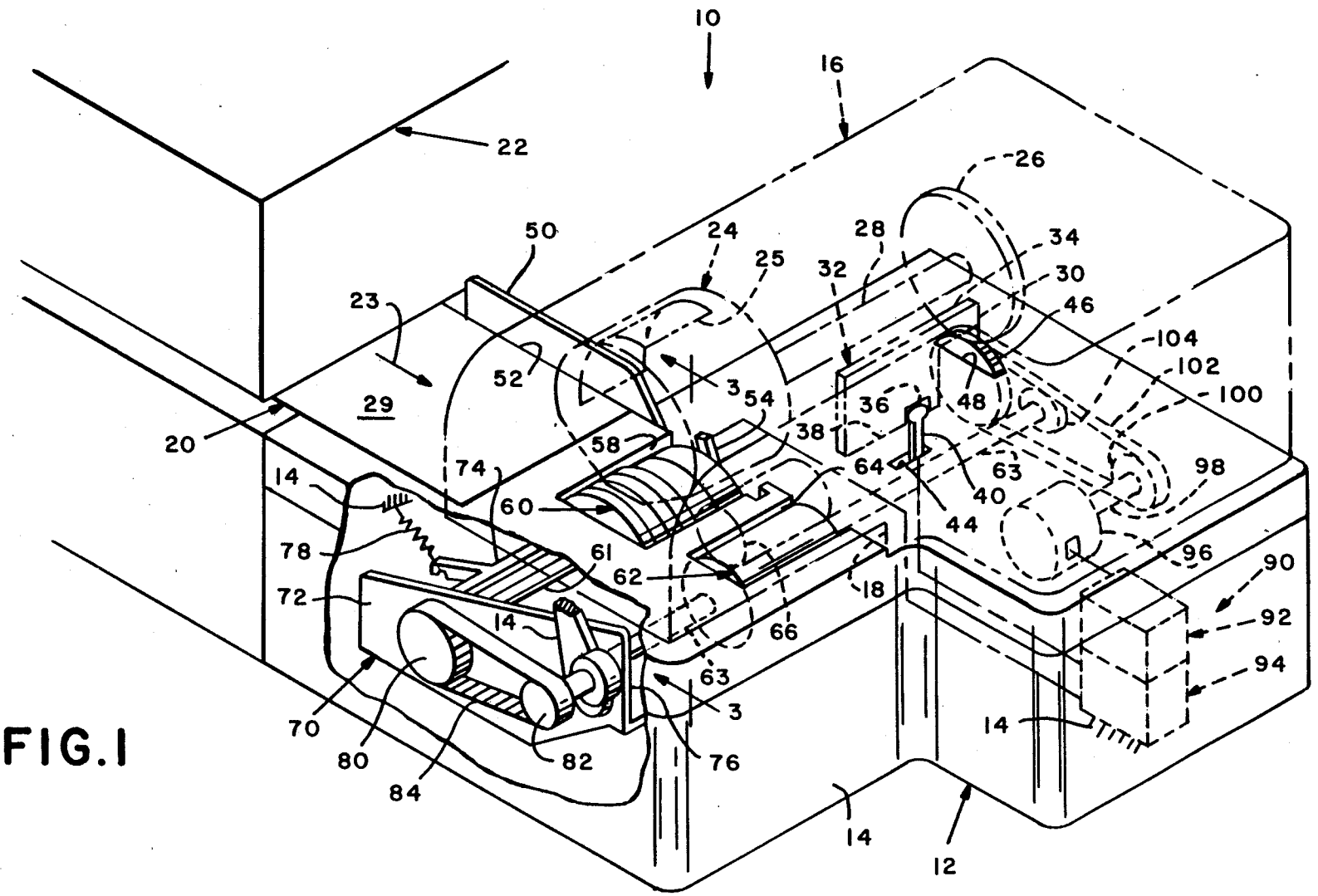
FIG. 1 is a partially phantom, perspective, view a mailing machine, which includes a postage meter removably mounted on a base, showing a postage indicia printing drum overhanging an impression roller according to the invention.

As shown in FIG. 1, the apparatus in which the invention is incorporated comprises a mailing machine 10 which generally includes a base 12, having a housing 14, and a postage meter 16 which is removably mounted on the base 12. When mounted on the base 12, the postage meter 16 forms therewith a slot 18 through which sheets 20, including mailpieces such as letters, envelopes, cards or other sheet-like materials, are fed to the machine 10, either by hand or by suitable sheet feeding apparatus 22, in a downstream path of travel 23.

The postage meter 16 (FIG. 1) generally comprises rotary printing structure including a drum 24, having conventional postage indicia printing structure generally designated by the numeral 25. In addition, the meter 16 includes a drive gear 26 which is spaced apart from the drum 24 and mounted on a common shaft 28. The drum 24 is conventionally constructed and arranged for feeding the respective sheets 20 in the path of travel 23, which extends beneath the drum 24, and for printing postage indicia on the upwardly disposed surface 29 of each sheet 20. The drum drive gear 26 has a key slot 30 formed therein, which is located vertically beneath the drum drive shaft 28 when the drum 24 and drive gear 26 are located in their respective home positions. The postage meter 16 additionally includes a shutter bar 32, having an elongate key portion 34 which is transversely dimensioned to fit into the drive gear's key slot 30. The shutter bar 32 is conventionally reciprocally mounted within the meter 16 for movement of the key portion 34 into and out of locking engagement with the drum drive gear 26 when the gear 26 is located in its home position. To that end, the shutter bar 32 has a channel 36 formed thereinto from its lower surface 38, and, the mailing machine's base 12 includes a movable lever arm 40 which extends upwardly through an aperture 44 formed in the housing 14. When the meter 16 is mounted on the base 12, the lever arm 40 fits into the channel 36 in bearing engagement with the shutter bar 32 for reciprocally moving the bar 32. When the shutter bar's key portion 34 is disposed in the gear's key slot 30, rotation of the gear 26 and drum 24 are prevented, whereas when the key position 34 is disposed out of the key slot 30, rotation of the gear 26 and drum 24 are permitted. And, for driving the gear 26 and thus the drum 24, the base 12 includes a drive system output gear 46 which extends upwardly through another housing aperture 48 and into meshing engagement with the gear 26.

The base 12 (FIG. 1) additionally includes sheet aligning structure including a registration fence 50 against which an edge 52 of a given sheet 20 is normally urged when fed to the mailing machine 10. Further, the base 12 includes structure for sensing sheets 20 fed to the machine 10, including a trip lever 54 which extends upwardly through another housing aperture 58 and into the path of travel 23 of the sheets 20 fed to the machine 10. Moreover, the base 12 includes an input feed roller 60 according to the invention, which is known in the art as an impression roller. The impression roller 60 is preferably secured to a driven shaft 61 as hereinafter discussed. And the shaft 61 is conventionally connected to the housing 14, for example as hereinafter discussed, for causing the roller 60 to extend upwardly through the housing aperture 58 and into the path of travel 23 for urging sheets 20 into printing engagement with the drum 24 and cooperating therewith for feeding the sheets 20 downstream in the path of travel 23 through the machine 10.

For feeding sheets 20 (FIG. 1) from the mailing machine 10, the base 12 includes a conventional output feed roller 62, known in the art as an ejection roller, and includes a driven shaft 63 to which the roller 62 is suitably connected. The shaft 63 is conventionally rotatably connected to the housing 14 for causing the roller 62 to extend upwardly through a further housing aperture 64 and into the path of travel 23. Moreover, the postage meter 16 includes a suitable idler roller 66, which is conventionally yieldably mounted to accommodate mixed thickness sheets 20 when the meter 16 is mounted on the base 14. As thus mounted, the idler roller 66 extends downwardly into the path of travel 23. Preferably, the idler roller 66 is also conventionally movably mounted for adjusting vertical spacing thereof from the ejection roller 62, to accommodate feeding a given batch of relatively thick sheets 20, such as a batch of stepped letter mailpieces which each include an envelope stuffed with enclosures. Thus, the rollers, 62 and 66, are constructed and arranged to accommodate feeding sheets 20 of mixed thickness therebetween and downstream in the path of travel 23 from the machine 10.

The base 12 (FIG. 1), and thus the mailing machine 10, may also includes an elongate impression roller carriage 70 which includes a pair of parallel-spaced side walls 72, one of which is shown, and includes a lower wall 74 which extends between and is suitably secured to, or integrally formed with, the side walls 72. One end of each of the carriage side walls 72 is pivotably attached to the housing 14 as by means of bearings 76, one of which is shown, within which the ejection roller shaft 63 is rotatably mounted. The carriage 70 extends in a generally horizontal direction from the ejection roller shaft 63, and also extends beneath and in supporting relationship with the impression roller shaft 61. Moreover, the side walls 72 are conventionally constructed and arranged for rotatably supporting the opposed ends of the impression roller shaft 61. And, the carriage's lower wall 74 is connected to the housing 14 by means of a depending spring 78. Further, the base 12 includes a driven gear 80 which is suitably fixedly connected to, or integrally formed with, the impression roller shaft 61. In addition, the base 12 includes a driven gear 82, which is suitably fixedly connected to, or integrally formed with, the ejection roller shaft 63. And, the base 12 includes an endless gear belt 84 which is looped about the gears, 80 and 82, and disposed in meshing engagement therewith. As thus constructed and arranged, when the impression roller 60 is urged downwardly, the impression roller shaft 61 and gear 80 are urged downwardly as the carriage 70 pivots downwardly about the ejection roller shaft 63, against the force exerted on the carriage 70 by the spring 78, to provide a variable gap between the drum 24 and impression roller 60 to accommodate mixed thickness sheets 20. And the spring 78 resiliently urges the carriage 70, and thus the impression roller 60, upwardly against any downwardly directed force exerted on the impression roller 60 by a given sheet 20 fed beneath the postage indicia printing drum 24, for urging mixed thickness sheets 20 into printing engagement with the drum 24.

In addition, the base 12 (FIG. 1), and thus the mailing machine 10, includes an intermittently operable, electromechanical, drive system which is generally designated by the numeral 90. The drive system 90 is conventionally constructed and arranged for driving the shutter bar lever arm 40 and thus the shutter bar 32, the output gear 46 and thus the postage meter drum 24, and the roller shaft 63 and thus the roller 60, preferably in timed relationship with one another, in response to movement of the trip lever 54 by a sheet 20 fed to the machine 10.

More particularly, the drive system 90 (FIG. 1) includes a suitable control system 92 and trip structure 94, which are conventionally supported by the housing 14. The trip structure 94 is suitably connected to the trip lever 54 and to the control system 92. The drive system 90 also includes a motor 96 which is conventionally connected to the control system 92 and has an output shaft 98 with a pinion gear 100 mounted thereon. In addition, the drive system 90 includes a gear belt 102, which is endlessly looped about the pinion gear 100 and about a drive gear (not shown) which is conventionally attached to the gear 46, for transmitting motor drive from the gear 100 to the gear 46 and thus to the drum drive gear 26 and drum 24. Moreover the drive system 90 includes a drive gear 104, which is mounted on the ejection roller shaft 63 and disposed in meshing engagement with the gear belt 102. Since the gear belt 102 drives the drum 24 as hereinbefore discussed, and also drives the impression roller 60, via the ejection roller shaft 63, gear 82, belt 84, gear 80 and shaft 61, the postage indicia printing drum 24 and impression roller 60 are driven in timed relationship with one another by the motor 96. Further, the drum 24 and impression roller 60, and driving structures therefor, are constructed and arranged to ensure that the peripheral speeds of the drum 24 and impression roller 60 are substantially equal to one another when they are both disposed in feeding engagement with a sheet 20 fed to the machine 10.

Figure 2:
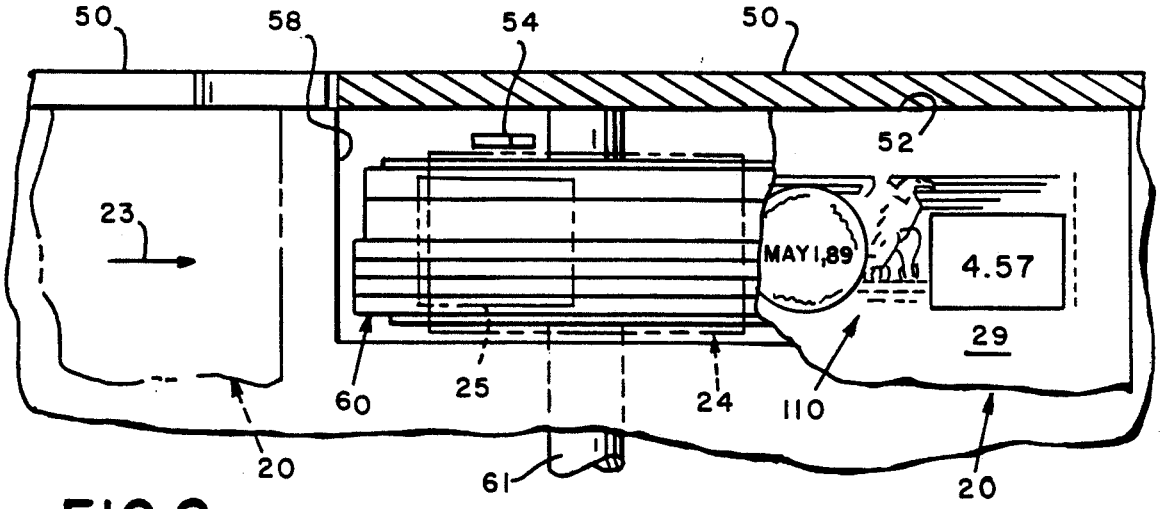
FIG. 2 is a partially schematic top view of a portion of the mailing machine of FIG. 1, showing a letter mailpiece being fed between the postage indicia printing drum and impression roller, and showing a typical postage indicia printed on the mailpiece by the drum.

In operation, when a sheet 20 (FIG. 2) is fed to the base 12, the sheet edge 52 is urged into engagement with the registration fence 50 and the sheet 20 is fed downstream, in the direction of path of travel 23, and into the slot 18 (FIG. 1) between the base 12 and meter 16 for engagement with the trip lever 54. The force exerted by the sheet 20 against the trip lever 54 causes the trip lever 54 to move, whereupon, the trip structure 94 causes the control system 92 to energize the motor 96. When the motor 96 is energized, the motor output shaft 98 drives the gear 100, thereby driving the gear belt 102 for rotating the postage indicia printing drum 24 and impression roller 60. When the drum 24 rotates into engagement with the sheet 20 the drum's postage indicia printing structure 25 prints a postage indicia 110 (FIG. 2) on the upper surface 29 of the sheet 20, as the drum 24 (FIG. 1) and impression roller 60 feed the sheet 20 downstream in the path of travel 23 beneath the drum 24, and then between the ejection roller 62 and idler roller 66 which conventionally feed the sheet 20 from the machine 10.

Figure 3:
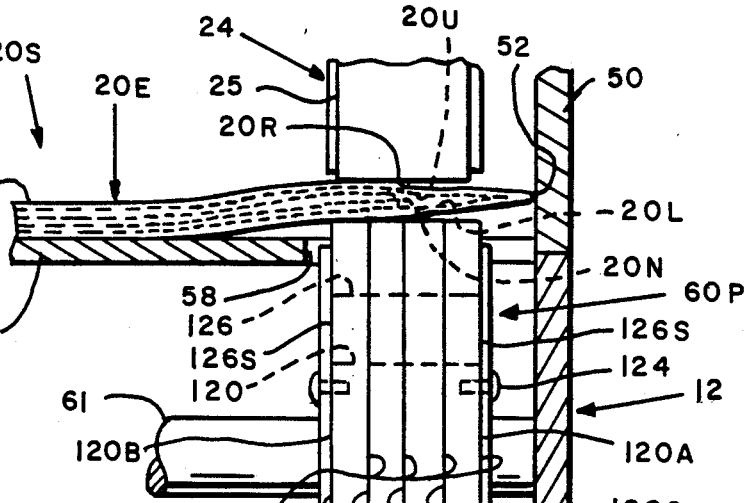
FIG. 3 is a partial sectional view of the mailing machine of FIG. 1, taken substantially along the line 3—3 thereof, showing the impression roller of FIG. 1 changed to an impression roller of the prior art, and showing the postage indicia printing drum engaging a stepped letter mailpiece for printing thereon.

As shown in FIG. 3, a typical stepped letter mailpiece 20S includes an envelope 20E, having an upwardly oriented, or upper, wall 20U, and having a downwardly oriented, or lower, wall 20L. The walls, 20U and 20L, generally curvedly extend toward each other and merge with one another to form the elongate side edge 52 of the envelope 20E. In addition, the stepped letter mailpiece 20S typically includes an enclosure 20N, within the envelope 20E, which includes a plurality of folded sheets, or cards or other sheet-like materials. Due to the enclosure 20N being relatively thick and being spaced apart from the envelope edge 52, the stepped letter mailpiece 20S typically includes at least one elongate ridge 20R, or step, formed in the envelope 20E by the enclosure 20N. Moreover, due to the ridge or step 20R interfering with the drum's postage indicia printing structure 25 engaging the upper surface 29 of the envelope 20E, there has been a long felt need to provide structure for urging the envelope's upper surface 29 into printing engagement with the drum 24.

The impression roller 60P (FIG. 3) is a typical prior art impression roller 60P constructed and arranged for urging an envelope's upper surface 29 into printing engagement with a drum's postage indicia printing structure 25. For driving the roller 60P the machine 10 is preferably provided with shaft structure including the impression roller shaft 61 and a cylindrically-shaped arbor 120 having an inboard end 120A and an outboard end 120B. The arbor 120 is conventionally fixedly attached to the shaft 61 for rotation therewith. In addition, the driving structure includes a pair of annularly-shaped end, or retainer, plates 122, which are spaced apart from one another and conventionally fixedly attached to the shaft 61 for rotation therewith, as by means of fasteners 124 which fixedly attach the plates 122 to the opposed ends, 120A and 120B, of the arbor 120 and thus to the shaft 61.

The impression roller 60P (FIG. 3) includes an elongate cylindrically-shaped inner member having a longitudinal length corresponding to that of the arbor 120 and having opposed ends or sides 126. The inner members 126 is made a soft resilient material such as foam rubber, or the like, and is coaxially mounted on, and suitably fixedly connected to, the arbor 120, between the retainer plates 122. Moreover, the impression roller 60P includes a plurality of, such as four, annularly-shaped outer members 128, made of a hard resilient material such as rubber or polyurethane, or the like, having a durometer level of substantially 50 to 60. The outer members 128 are each coaxially mounted on an inner member 126 between the retainer plates 122. And the members, 126 and 128, are held in place by the retainer plates 122 against lateral movement on the arbor 120. Further, the inner and outer members 126 and 128 are preferably held by the plates 122 aqainst rotation relative to one another. On the other hand, the inner and outer members, 126 and 128, are not fastened to one another or to the retainer plates 122, with a view to promoting independent radial movement of the outer members 128 relative to one another.

Notwithstanding the aforesaid construction and arrangement of the prior art impression roller 60P (FIG. 3), the outer members 128 are not sufficiently independently movable relative to one another. Rather, it has been found that when each of the outer members 128 is compressed, in response to the force exerted thereon by a stepped letter mailpiece 20S being urged towards the roller 60P by the printing drum 24, the outer member side surfaces 128S tend to bulge outwardly. As a result, the side surfaces 128S frictionally engage the side surface(s) 128S of the adjacent outer member(s) 128 causing the adjacent outer member(s) 128 to tend to be either urged away from the mailpiece 20S or prevented from urging the mailpiece 20S towards the drum 24, or both. As a consequence, the prior art impression roller 60P cannot be relied upon to urge the upper surface 29 of a stepped letter mailpiece 20S into printing engagement with the drum's postage indicia printing structure 25.

Figure 6:
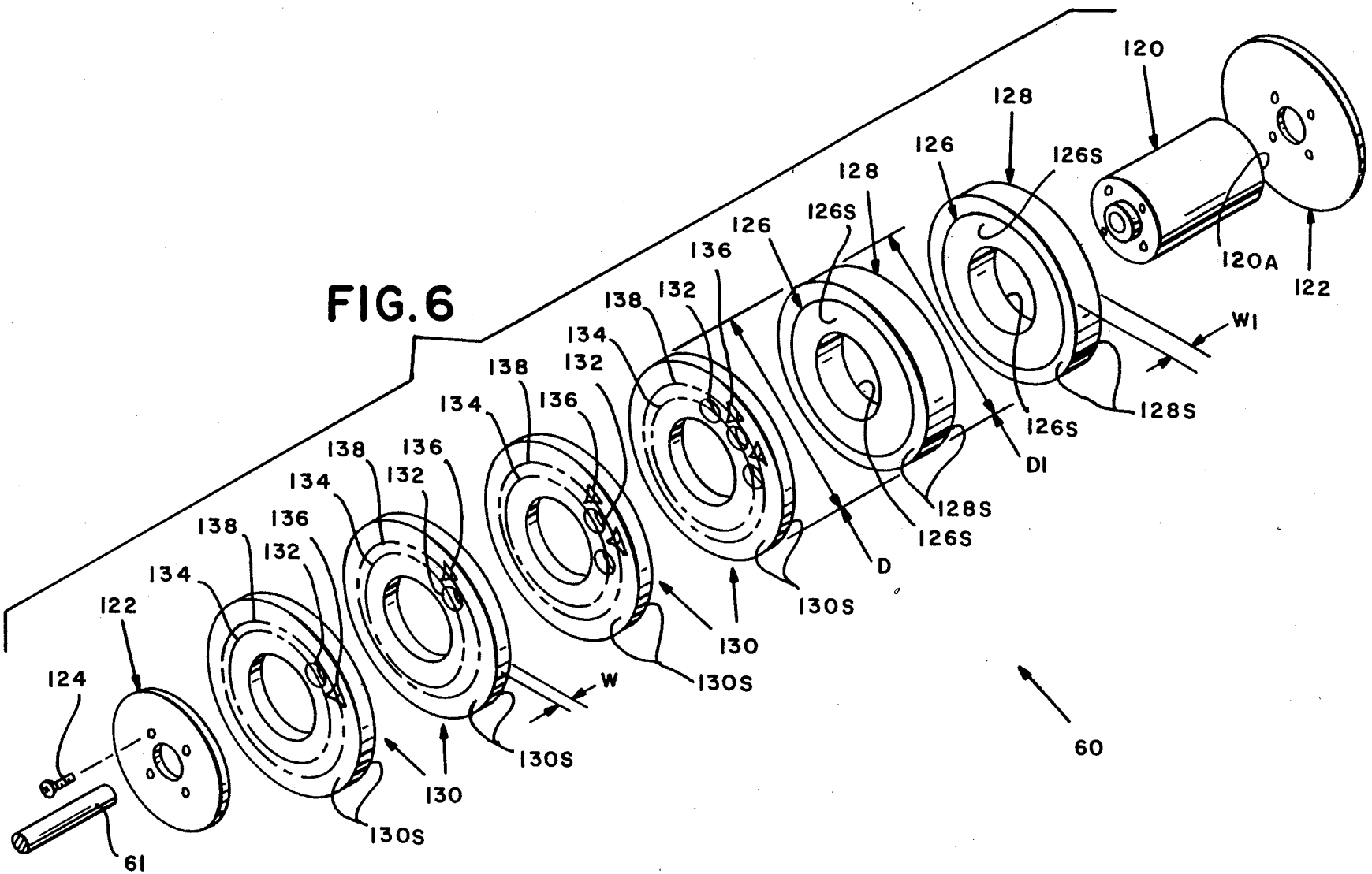
FIG. 6 an exploded perspective view of the impression roller of FIGS. 1, 4 and 5, including structure for driving the impression roller.

According to the invention, the impression roller 60 (FIG. 6) preferably includes, two inner members 126 made of a soft resilient material coaxially mounted side by side on the arbor 120. In addition, according to the invention, the overall longitudinal length of the mounted inner members 126 is half that of the arbor 120. Moreover, the inner members 126 are preferably mounted on the arbor 120 such that one side 126S, of one of the members 126 is aligned with the inboard end 120A of the arbor 120. In addition, the roller 60 includes two prior art outer members 128, made of a hard resilient material, which are coaxially mounted on the inner members 126. Further, the roller 60 includes a plurality of annularly-shaped disc numbers 130, made of a hard resilient material, which are coaxially mounted on the arbor 120. Preferably, the disc members 130 are each frictionally mounted on the arbor 120 and are rotatable against frictional engagement with the arbor 120. Thus the disc members are substantially rotatably mounted on the arbor 120. Each of the disc members 130 has an outer diameter "d" which is greater than the outer diameter "$d_1$" of an outer member 128. In addition, the width "w" of each of the disc members 130 is half the width "$w_1$" of that of an outer member 128. Further, each of the disc members 130 includes a first plurality of apertures 132 formed therethrough and located at equidistantly spaced intervals along a first circular line 134 extending coaxially of the disc member 130. Preferably, the first plurality of apertures 132 are each circularly-shaped. Moreover, each of the disc members 130 includes a second plurality of apertures 136 formed therethrough and located at equidistantly spaced intervals along a second circular line 138 extending coaxially of the disc member 130. Preferably, the second plurality of apertures 136 are each generally triangularly-shaped and one of the second apertures 132 is located between each pair of adjacent apertures 136, such that the amount of material separating each of the apertures, 132 and 136, from one another or from the outer periphery of the disc member 130 is substantially the same, thereby promoting uniform compression of each disc number 130 in response to exterior forces exerted on the disc members 130 along lines coincident with radii of the disc members 130. A more detailed discussion of the relative dimensional relationship of the disc material and apertures 132 and 136 can be found in U.S. Pat. No.

4,425,694, issued Jan. 17, 1984 to R. C. Somerville and assigned to Globe Rubber Works, Inc.

Figure 5:
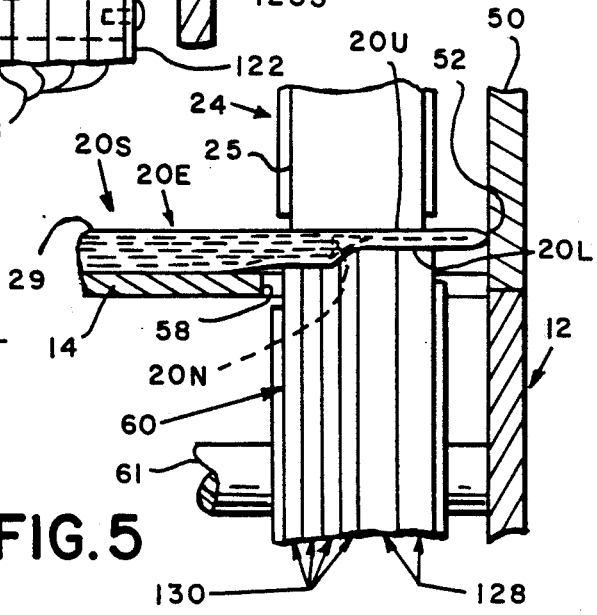
FIG. 5 is another view of FIG. 4, showing the postage indicia printing drum thereof engaging a stepped letter mailpiece for printing thereon.

According to the invention, it has been found that, in general, utilization of four disc members 130 (FIG. 6), each having a width dimension "w" of half the width "$w_1$" of an outer member 128, rather than using fewer disc members 130, or rather than using disc members 130 which are differently dimensioned relative to one another, or rather using all disc members 130 and no inner or outer members, 126 or 128, is critical to the use of such disc members 130 in a mailing machine. Moreover, it has been found that it is still more critical that the width "w" of each disc member 130 be not more than substantially one-eighth of an inch, that is, one-eighth of an inch plus five thousandths of an inch leeway for manufacturing tolerance purposes, to ensure that each disc member 130 is independently radially compressible. As thus constructed and arranged, in the course of compression thereof the disc member side surface(s) 130S do not appreciably frictionally engage the side surface(s) 130S of any adjacent disc member(s) 130 or side surface 128S of the adjacent outer member 128, as the case may be. As a consequence, such disc members 130, do not cause an adjacent disc members 130 or the adjacent outer member 128, to tend to be either urged away from a stepped letter mailpiece 20S (FIG. 5) or tend to be prevented from urging the stepped letter mailpiece 20S towards the drum 24. Accordingly, an impression roller 60 according to the invention can be relied upon to urge the upper surface 29 of a stepped letter mailpiece 20S into printing engagement with the drum's postage indicia printing structure 25.

Figure 4:
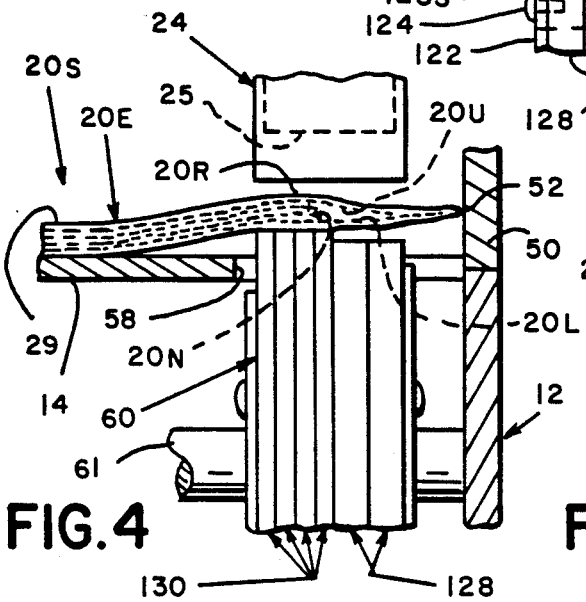
FIG. 4 is a view of FIG. 3, showing the impression roller therein changed to the impression roller of FIG. 1 and showing the postage indicia printing drum prior to printing on a stepped letter mailpiece.

As shown in FIG. 4, as a stepped letter mailpiece 20S is fed between the postage printing drum 25 and the impression roller 60 according to the invention, the mailpiece's side edge 52 engages the registration fence 50 and is fed into overlying relationship with the impression roller 60. As thus situated the mailpiece's step or ridge 20R is located in overlying relationship with respect to the disc members 130. Thereafter, as the stepped letter mailpiece 20S (FIG. 5) is engaged by the rotating printing drum 24, and urged downwardly towards the impression roller 60, the disc members 130 are independently radially compressed relative to one another, to accommodate downward movement of the envelope's lower wall 20L and enclosure 20N, against the resilient energy stored in the members 130. And the disc members 130 tend to urge the mailpiece's upper wall 20U, and thus the envelope's upper surface 29, upwardly toward the postage indicia printing structure 25, as a result of which the printing structure 25 prints a clear and legible, substantially undistorted, postage indicia 110 (FIG. 2) on the upper surface 29 (FIG. 5) of stepped letter mailpieces 20S.

In accordance with the objects of the invention there has been described a mailing machine including improved means for printing postage indicia on stepped letter mailpieces, and more particularly an improved impression roller for urging stepped letter mailpieces into engagement with the rotary postage indicia printing drum of the machine's postage meter Although the invention disclosed herein has been described with reference to a simple embodiment thereof, variations and modifications may be made therein by persons skilled in the art without departing from the spirit and scope of the invention. Accordingly, it is intended that the following claims cover the disclosed invention and such variations and modifications thereof as fall within the true spirit and scope of the invention.

What is claimed is:

1. In a mailing machine including an impression roller, a postage indicia printing drum overhanging the impression roller, and means for rotating the impression roller and drum in timed relationship with one another for feeding a sheet beneath the drum and in printing engagement therewith, wherein the feeding means includes shaft means on which the impression roller is mounted for rotation therewith, an improved impression roller comprising:

a. two annularly-shaped inner members made of a soft resilient material, the inner members coaxially mounted side by side on the shaft means;

b. two annularly-shaped outer members made of a hard resilient material, the outer members coaxially mounted on the inner members; and c. four annularly-shaped disc members made of a hard resilient material, the disc members coaxially mounted on the shaft means, each of said disc members dimensioned such that the width thereof is half the width of an outer member, and each of said disc members including a plurality of apertures formed therethrough at equidistantly spaced intervals along a circular line extending coaxially thereof.

2. The improvement according to claim 1, wherein each of said disc members has a larger outer diameter than that of an outer member.

3. The improvement according to claim 1, wherein each of said disc members is frictionally mounted on said shaft means.

4. The improvement according to claim 1, wherein each of said disc members is rotatably mounted on said shaft means.

5. The improvement according to claim 1, wherein said plurality of disc apertures is a first plurality thereof, said circular line is a first circular line, and each of said disc members including a second plurality of apertures formed therethrough at equidistantly spaced intervals along a second circular line extending coaxially thereof.

6. The improvement according to claim 1, wherein said second apertures of each disc member are each located between two adjacent first apertures.

7. The improvement according to claim 1, wherein the shaft means includes means for retaining the inner, outer and disc members in place against lateral movement.

8. The improvement according to claim 1, wherein the width of each disc member is not more than substantially one-eighth of an inch.

9. The improvement according to claim 5, wherein said first plurality of apertures are each circularly-shaped, and said second plurality of apertures are each triangularly-shaped.

10. In a mailing machine including an impression roller, a postage indicia printing drum overhanging the impression roller, and means for rotating the impression roller and drum in timed relationship with one another for feeding a sheet beneath the drum and in printing engagement therewith, wherein the feeding means includes shaft means on which the impression roller is mounted for rotation therewith, an improved impression roller comprising:

a. the shaft means including a shaft and an elongate cylindrically-shaped arbor having an inboard end and an outboard end, the arbor fixedly connected to the shaft, the arbor having a predetermined longitudinal length, b. two annularly-shaped inner members made of a soft resilient material, the inner members coaxially mounted side by side on the arbor and having an end thereof aligned with the inboard end of the arbor;

c. two annularly-shaped outer members made of a hard resilient material, the outer members coaxially mounted on the inner members; and d. four annularly-shaped disc members made of a hard resilient material, the disc members coaxially mounted on the arbor, each of said disc members having a larger outer diameter than that of an outer member, and each of said disc members including a plurality of apertures formed therethrough at equidistantly spaced intervals along a circular line extending coaxially thereof.

11. The improvement according to claim 10, wherein each of said disc members has a larger outer diameter than that of an outer member.

12. The improvement according to claim 10, wherein each of said disc members is frictionally mounted on said arbor.

13. The improvement according to claim 10, wherein each of said disc members is rotatably mounted on said arbor.

14. The improvement according to claim 10, wherein said plurality of disc apertures is a first plurality thereof, said circular line is a first circular line, and each of said disc members including a second plurality of apertures formed therethrough at equidistantly spaced intervals along a second circular line extending coaxially thereof.

15. The improvement according to claim 10, wherein said disc members are independently compressible against resilient energy stored therein when a force is exerted thereon by a sheet fed between the drum and roller, whereby each disc member independently of the other disc members tends to urge the upper surface of the sheet into printing engagement with the drum.

16. The improvement according to claim 10, wherein the width of each disc member is not more than substantially one-eighth of an inch.

17. The improvement according to claim 14, wherein said first apertures of each disc member are each circularly-shaped, and said second apertures of each disc member are each triangularly-shaped and located between adjacent circularly-shaped apertures.

18. In a mailing machine including an impression roller, a postage indicia printing drum overhanging the impression roller, and means for rotating the impression roller and drum in timed relationship with one another for feeding a sheet beneath the drum and in printing engagement therewith, wherein the feeding means includes shaft means on which the impression roller is mounted for rotation therewith, an improved impression roller comprising:

a. two annularly-shaped inner members made of a soft resilient material, the inner members coaxially mounted side by side on the shaft means;

b. two annularly-shaped outer members made of a hard resilient material, the outer members coaxially mounted on the inner members; and c. four annularly-shaped disc members made of a hard resilient material, the disc members coaxially mounted on the shaft means, each of said disc members dimensioned such that the width thereof is not more than substantially one-eighth of an inch, and each of said disc members including a plurality of apertures formed therethrough at equidistantly spaced intervals along a circular line extending coaxially thereof.

19. The improvement according to claim 18, wherein each of said disc members has a larger outer diameter than that of an outer member.

20. The improvement according to claim 18, wherein each of said disc members is frictionally mounted on said shaft means.

21. The improvement according to claim 18, wherein each of said disc members is rotatably mounted on said shaft means.

22. The improvement according to claim 18, wherein said plurality of disc apertures is a first plurality thereof, said circular line is a first circular line, and each of said disc members including a second plurality of apertures formed therethrough at equidistantly spaced intervals along a second circular line extending coaxially thereof.

23. The improvement according to claim 18, wherein said second apertures of each disc member are each located between two adjacent first apertures.

24. The improvement according to claim 18, wherein the shaft means includes means for retaining the inner, outer and disc members in place against lateral movement.

25. The improvement according to claim 22, wherein said first plurality of apertures are each circularly-shaped, and said second plurality of apertures are each triangularly-shaped.

* * * * *